US005282511A

United States Patent [19]

Burenga et al.

[11] Patent Number: 5,282,511

[45] Date of Patent: Feb. 1, 1994

[54] POST DRIVER WITH IMPROVED BEARING MEANS

[75] Inventors: Thomas I. Burenga, Litchfield; Ross D. Koberlein, Brownstown, both of Ill.

[73] Assignee: Worksaver, Inc., Litchfield, Ill.

[21] Appl. No.: 927,010

[22] Filed: Aug. 10, 1992

[51] Int. Cl.[5] ..... B25D 17/28

[52] U.S. Cl. ..... 173/184; 173/90

[58] Field of Search ..... 173/184, 90, 91, 28

[56] References Cited

U.S. PATENT DOCUMENTS

| | | | |
|---|---|---|---|
| 799,090 | 9/1905 | Raymond | 173/28 |
| 2,014,631 | 9/1935 | Pace et al. | 173/184 |
| 2,639,589 | 5/1953 | Smith | 173/91 |
| 2,805,847 | 9/1957 | Malloy | 173/184 |
| 3,917,005 | 11/1975 | Cannon et al. | 173/28 |
| 4,099,579 | 7/1978 | Stormon | 173/28 |
| 4,439,056 | 3/1984 | Reilly et al. | 173/90 |

*Primary Examiner*—Scott Smith

*Attorney, Agent, or Firm*—Paul M. Denk

[57] ABSTRACT

A bearing block for use in providing the bearinged relationship between the carriage and reciprocal moving driving ram of a post driver. The carriage includes a pair of channel forming bearing surfaces between these two operating components so as to disseminate the impacting forces exerted through the bearings while the driving ram continuously pounds a fence or other post into the ground.

3 Claims, 1 Drawing Sheet

POST DRIVER WITH IMPROVED BEARING MEANS

BACKGROUND OF THE INVENTION

This invention relates to post drivers, and in particular, pertains improvements in the bearing relationship of the various operating components incorporated within the post driver to sustain its useful and effective life.

Post drivers typically include a base which is mounted to a tractor, normally by means of a three-point hitch. The post driver and its associated drive means, whether it be a hydraulically operated driver, pneumatically functioned, or mechanically actuated, generally include a base or carriage means that connects through a three-point hitch means to the tractor, and incorporates a driving ram thereon that reciprocates during functioning to provide repeat ramming of the post into ground, during its usage and application.

In the normally constructed post driver, the relationship between the driving ram, and its mounting upon the carriage, normally is provided through a bearinged relationship, and usually incorporating roller bearings, or a plurality of the same, are secured to the driving ram, and ride within channels formed to either side of the carriage means, so as to provide near frictionless shifting of the ram, during its reciprocal vertical movements while pounding upon the post, when driving it into the ground. As can be readily understood, the bearing contact between each roller, or a plurality of them, and the internal surfaces of the flanges forming the shaped channels provided integrally to either side of the carriage means, is just a line contact. It has been known, through many years of usage, that providing a bearing relationship between these operating components for a post driver, when tremendous forces and impacting pressures are exerted upon the bearings, during performance of the ramming function, generally leads towards deterioration at this interconnection between the carriage and its ram. Usually, the flanges of the carriage eventually become distorted, or bent out of shape, which leads towards looseness between the ram, and the carriage, during functioning, which cannot only lead to inaccuracy in driving of the post, but can also eventually cause a breakdown in the components, which may be hazardous, eventually, to the operator, and anyone in the vicinity nearby. Thus, the line-to-line contact on the channel flanges, through the bearing rollers of the prior art, is just too great of a concentration of the full load of impact exerted by the post driver on its operating components during sustained usage. Hence, the current invention is designed to alleviate this problem, by providing substantially sized bearing blocks as the means for providing a form of sliding engagement between the driving ram, and its carriage means, so as to spread out or disseminate that transfer of force between these components, while driving of a post, and eliminate that full load concentration as previously experienced during usage of the prior art type of post drivers.

SUMMARY OF THE INVENTION

This invention contemplates improvements to the structure of post drivers, which are intended to not only enhance the effectiveness of the operation of the driver while forcing a post into the ground, but to add to its safety of usage, by improving upon the structural relationship of the bearing means incorporated within the components of the driver. More specifically, this particular post driver utilizes the usual type of carriage means, that may be independently mounted upon the base during its usage, or connected through the operations of a hitch to the tractor. A driving ram is bearing mounted to the carriage means, which provides for its reciprocal shifting, usually vertically, or near vertically, which during its downward thrust exerts significant force upon the upper edge of the post, to gradually drive it into the ground. As is well known, post drivers of this type can be either mechanically, hydraulically, or pneumatically operated, to attain their functioning.

More particularly, either the carriage means, or the driving ram, but preferably the carriage, incorporates, integrally, channel means formed to either side, and which are designed for cooperating with the driving ram, which likewise is channel shaped, to furnish its reciprocal movement. The essence of this invention is to replace the roller bearings with slide or bearing blocks, that normally are mounted to the interior flanges of the channel forming the driving ram, and which bearing blocks are disposed for snug fitting within the carriage means formed channels, to thereby increase the surface area contact between these components, through this style of bearing means, in order to reduce or minimize deterioration, which may lead to loosening, or other distortion of the operating components, during sustained and repeat operations of the post driver, in continuously driving posts into the ground, during fence construction, or fence post replacement, all as previously explained.

More specifically, and in the preferred embodiment of this invention, the rollers were replaced with a pair of bearing blocks, one disposed to either side of the carriage means, and slidingly engage within its oppositely disposed channels, and easy calculations and empirical analysis can readily determine the enhanced bearing surfaces provided utilizing bearing blocks of this design, over the type of line-to-line contact afforded through usage of the previous rollers. More specifically, utilizing polymer blocks as the bearing means, the edges of each block that forms a bearing relationship between the driving ram and the carriage means is configured having dimensions of approximately a one inch by six inch surface. Hence, each edge of a bearing block may have six square inches of bearing surface, for sliding within the interior of the flanges forming the oppositely disposed channels of the carriage means. Hence, since at least four of such blocks will be incorporated into the post driver, with each block having two such bearing surfaces, the bearing contact between the ram, and its supporting carriage, will, in the preferred embodiment, afford a total of forty-eight square inches of bearing contact, through usage of this improved bearing means. When you consider that the bearing engagement provided through the use of rollers, of the prior art, affords only line contact, this insertion provides a significant increase in the formed contact bearing surface, which through experimentation, has been found to greatly reduce the distortions or impact line contact between these components, which substantially eliminates the eventual loosening that currently forms between the carriage and ram, of the prior art.

Obviously, while the description of the preferred embodiment for this particular improvement may explain that the carriage means provides the supporting channels for the blocks as mounted to the driving ram, it is just as likely that the driving ram may have the channels formed therein, facing each other, and ride upon the blocks fixed to the carriage means, and extending laterally in opposite directions from each other. Furthermore, while the preferred embodiment may describe that four such bearing blocks may be embodied within the structure of this post driver, it is just as likely that more such bearing blocks may be provided, where the force requirements of the ram may be significant, in order to further stabilize the bearinged relationship of the various components forming the post driver of this invention.

Further variations upon the structure of this invention may occur to those skilled in the art upon reviewing this summary of the invention as provided herein, and upon undertaking a study of the description of the preferred embodiment in view of the drawing.

BRIEF DESCRIPTION OF THE DRAWING

In referring to the drawing, FIG. 1 provides a side view of the post driver of this invention, shown mounted to the three point hitch of the tractor, the latter being disclosed in phantom line.

DESCRIPTION OF THE PREFERRED EMBODIMENT

Figure 1:
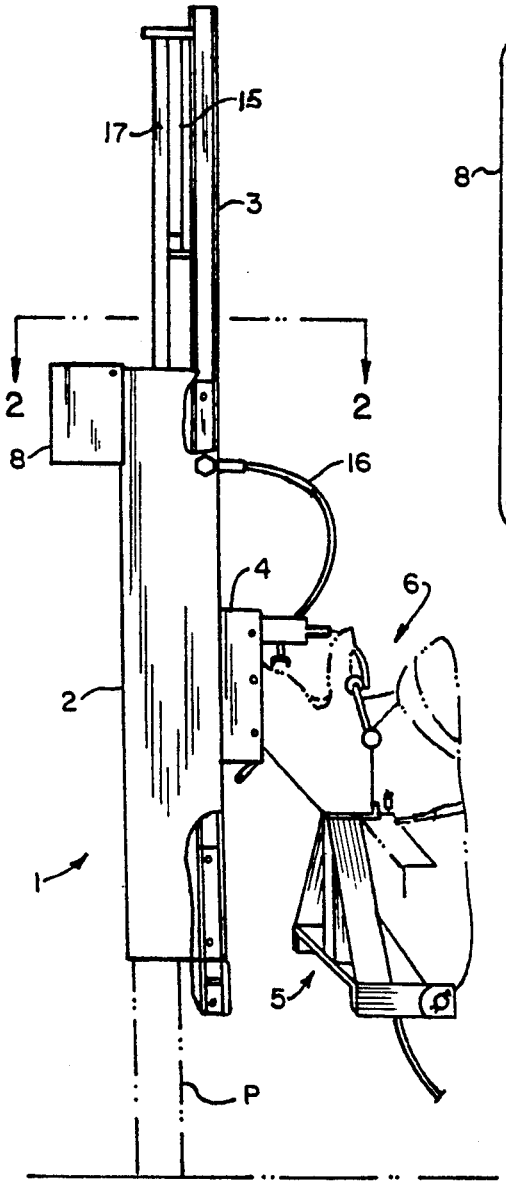

In referring to the drawing, and in particular FIG. 1, the post driver 1 of this invention is disclosed. In its embodiment, it includes a driving ram 2 that bearing mounts upon the carriage means 3, so that the ram can have reciprocal movement or shifting with respect to the carriage, during usage and application of this driver, as is well known in the art. The carriage means 3 connects by means of a mount, as at 4, to a mounting assembly 5, which secures it with the three point hitch 6 of a tractor, or the like. Obviously, as previously explained, the post driver of this design may mount to other structures, to provide it with support during usage and application.

Figure 2:
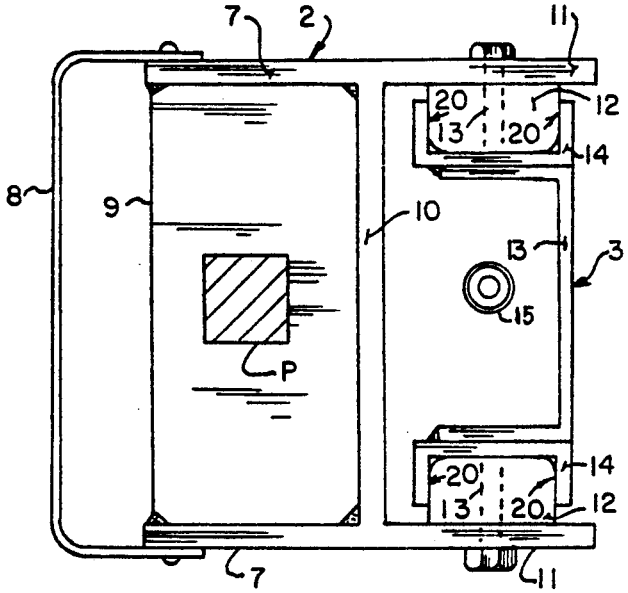
FIG. 2 provides a cross sectional view of the structured relationship between the carriage means, and the supported driving ram, taken along the line 2—2 of FIG. 1.

As can further be seen, as in FIGS. 1 and 2, the driver is used for driving a fence or other post P deeply into the ground.

As can further be seen, the driving ram 2 may be formed having that shape which can provide for its cooperative application with the carriage means, and also furnish means for supporting the instrumentation for guiding the post during the forced ramming of it into the ground. Normally, the driving ram is formed of a structure having an I-beam shape, in cross section, as can be seen in FIG. 2. Its forwardly extending flanges 7 include various bracing, as at 8, and which function as a retainer for supporting those means for aligning the post during the driving function, and further provides a guard against the emitting of fragments while the post P is being driven into the ground. Also, the driving ram usually includes some form of a plate 9, which is welded or otherwise secured within the flanges 7, and to the web 10, of the ram 2, to provide the impacting force exerted by the driving ram upon the post while driving it into the soil.

Extending rearwardly from the driving ram 2 are a pair of additional integral flanges 11, and these flanges are designed for holding the bearing blocks 12, fixing the same into position by means of pin mounts, or the bolts 13, as can be seen. As previously explained, in the preferred embodiment, there may be a pair of said bearing blocks provided upon each of the flanges 11, generally located at the upper and lower ranges of the movement of the driving ram 2, when riding upon the carriage means 3, and in which the bearing blocks 12 snuggly insert, but which are free to provide for vertical shift of the driving ram 2, with respect to the stationary carriage means 3, during functioning of this post driver.

As is well known in the art, the relative shifting of the driving ram 2, with respect to the supporting carriage means 3, is normally obtained through the use of hydraulics, or pneumatics, with the prime mover being a pressure generating cylinder, as at 15, which conducts its fluid pressure through various conduits, as at 16, to the hydraulic or pneumatic pressure cylinder tube that is embodied within the carriage means, to provide for its raising or lowering, through the linkage 17. As previously explained, the driving of the ram 2 may be achieved either through hydraulics, pneumatics, or perhaps even be mechanically actuated, to attain that repeat reciprocal shifting between the ram and its supporting carriage means 3.

Figure 3:
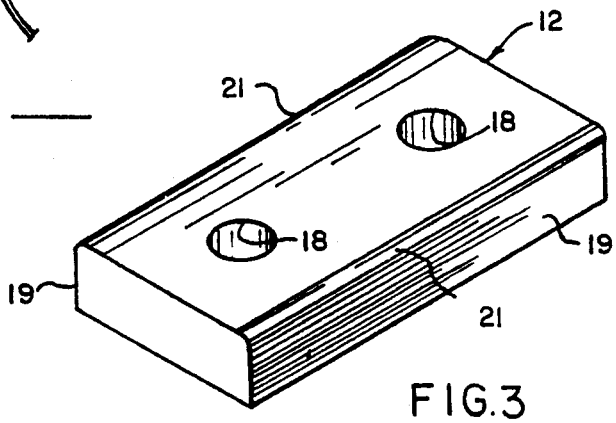
FIG. 3 provides an isometric view of one of the bearing blocks of this invention.

FIG. 3 discloses a configuration of the bearing means or block 12 of this invention. As can be seen, each block may have dimensions related to that as previously described herein, and may be secured to the interior of the flanges 11 by means of the bolts or supporting pins 13, that extend through or threadily engage within the formed apertures 18. As can be noted, the actual bearing surface of each block are those surfaces 19 provided to either side of the block, and which ride upon the inner surfaces of the flanges 14, providing bearing engagement at the various regions identified at 20. It is this substantial increase in bearing surface provided between the various bearing blocks, and the flange surfaces upon which they ride, that significantly increases the bearing relationship between the ram and carriage, and which has been found to reduce the problems associated with the prior art types of post drivers, where the full load is concentrated at line contact, because of the then prevalent usage of rollers, as the means for providing the bearing relationship between these operating components.

As can also be seen, each block may include a clearance edge, as at 21, and which prevents the generation or development of any friction or suction, or other forms of resistant interconnection between the components, at the location where their bearing means 12 slide within the flanges of the channels 14, during usage of the driver.

Through usage of the structural components as identified herein, in the formation of a post driver, the isolated impacting forces that were generated upon the flanges of the carriage means, where roller bearings were utilized to afford the reciprocal vertical shifting of the ram with respect to its carriage, such line forces caused a spread between the flanges of the channel 14, because of that line contact, and which cause the driver to function with far too looseness in actuating its driving ram. Such has been obviated herein.

Furthermore, as previously alluded to, it is likely that the bearing means 12 of this invention may be situated upon or connected with the carriage means, and ride within the flanges of channels that may be fixed to the interior of the flanges 11 of the driving ram, which, it is believed, may function just as effectively to eliminate the problems associated with the prior art.

Variations or modifications to the subject matter of this invention may occur to those skilled in the art upon reviewing the disclosure herein. Such variations or modifications, if within the spirit of this invention, are intended to be encompassed within the scope of any claims to patent protection issuing upon this invention. The description of the preferred embodiment set forth herein is done so for illustrative purposes only.

Having thus described the invention what is claimed and desired to be secured by Letters Patent is:

1. Bearing means for use in a post driver of the type having a carriage means connectable by a frame to a three-point hitch to a tractor, and incorporating a driving ram shiftably mounted to the carriage means for driving a post into the ground, the improvement comprising, said bearing means disposed between the carriage means and the driving ram to provide sustained and stable support for the ram during its repeat reciprocal shift when driving a post into the ground, at least one bearing surface formed of the carriage means, at least two bearing blocks fixed to the driving ram and each bearing block contiguously sliding upon one of said at least one bearing surface during driver operation, whereby a substantial area of each bearing block contacts one of said at least one bearing surface to reduce wear from loosening or distorting each bearing block during sustained driver usage, said carriage having a pair of channels formed at opposite sides thereof, said channels having openings therein, and said channel openings facing away from each other, said driving ram also being channel shaped and having said bearing blocks fixed interiorly thereof and extending towards each other, and said bearing blocks being contiguously slidably disposed within the carriage means channels to form a bearing relationship when the driving ram reciprocates upon its carriage means during post driver application, said bearing blocks being formed of polymer, each carriage means channel integrally having a pair of flanges, said flanges spaced apart and parallel arranged, each bearing block when disposed within a carriage means channel having substantial surface area contact with the carriage means channel flanges during sustained usage of the post driver.

2. The invention of claim 1 and including pins mounting each bearing block to the driving ram.

3. The invention of claim 1 and wherein each bearing block has a predetermined length, and a clearance edge provided along its length to reduce the development of any friction wherein a respective carriage means channel.

* * * * *

UNITED STATES PATENT AND TRADEMARK OFFICE

CERTIFICATE OF CORRECTION

PATENT NO. : 5,282,511

DATED : Feb. 1, 1994

INVENTOR(S) : Thomas I. Burenga, et al.

It is certified that error appears in the above—identified patent and that said Letters Patent is hereby corrected as shown below:

Column 6, line 25, change "wherein" to

---within---.

Signed and Sealed this

Thirty-first Day of May, 1994

Bruce Lehman

*Attest:*

BRUCE LEHMAN

*Attesting Officer*

*Commissioner of Patents and Trademarks*